US009194083B2

(12) United States Patent
Echeverria Garcia et al.

(10) Patent No.: US 9,194,083 B2
(45) Date of Patent: Nov. 24, 2015

(54) DOCTOR FOR A PAPER MACHINE

(71) Applicant: Xabier Echeverria Garcia, Tolosa (ES)

(72) Inventors: Xabier Echeverria Garcia, Tolosa (ES); Iñaki Almandoz Zapiain, Astigarraga (IS); Juan Ignacio Sancho Seuma, San Sebastian (ES); Juan Melendez Lagunilla, Andoain (ES)

(73) Assignee: Xabier Echeverria Garcia, Tolosa (ES)

( * ) Notice: Subject to any disclaimer, the term of this patent is extended or adjusted under 35 U.S.C. 154(b) by 0 days.

(21) Appl. No.: 14/557,436

(22) Filed: Dec. 1, 2014

(65) Prior Publication Data

US 2015/0159327 A1 Jun. 11, 2015

(30) Foreign Application Priority Data

Dec. 11, 2013 (EP) ..... 13382502

(51) Int. Cl.
*D21G 3/00* (2006.01)

(52) U.S. Cl.
CPC ..... *D21G 3/005* (2013.01)

(58) Field of Classification Search
CPC ..... D21G 3/005; D21G 3/00; D21G 9/0036; D21G 9/0045; B02C 4/40; B05C 11/041; B31F 1/14
USPC ..... 162/280–281; 118/413; 15/25.5, 256.51
See application file for complete search history.

(56) References Cited

U.S. PATENT DOCUMENTS

| | | | | | |
|---|---|---|---|---|---|
| 2,318,504 | A | * | 5/1943 | Lodding | 15/256.53 |
| 3,097,390 | A | * | 7/1963 | Thaler et al. | 15/256.51 |
| 3,688,336 | A | * | 9/1972 | Costello et al. | 15/256.51 |
| 4,413,507 | A | | 11/1983 | Drew et al. | |
| 4,770,568 | A | | 9/1988 | Perez et al. | |
| 5,221,351 | A | | 6/1993 | Esser et al. | |
| 5,942,991 | A | | 8/1999 | Gaudreau et al. | |

(Continued)

FOREIGN PATENT DOCUMENTS

| | | | |
|---|---|---|---|
| DE | 10214392 | A1 * | 10/2003 |
| DE | 102006019003 | A1 | 10/2007 |

(Continued)

OTHER PUBLICATIONS

European extended search Report, EP Application No. 13382502.6, Date of Mailing: Feb. 26, 2014, 4 pages, European Patent Office, Munich Germany.

*Primary Examiner* — Jose Fortuna
(74) *Attorney, Agent, or Firm* — Tim L. Kitchen; Peter B. Scull; Hamilton DeSanctis & Cha, LLP

(57) ABSTRACT

A doctor for a paper machine that according to some implementations includes a blade, a wearing element located in or on the blade so that at least a portion of the wearing element is exposed to wear as the blade is worn, and a reading element positioned in proximity to the wearing element. The reading element is configured to emit a magnetic signal to excite the wearing element and the wearing element is configured to respond to the magnetic signal with a magnetic response signal. The reading element is in turn configured to receive the magnetic response signal, the magnetic response signal comprising a frequency that varies with the wear of the wearing element such that the frequency of the magnetic response signal is representative of the wear of the wearing element.

19 Claims, 4 Drawing Sheets

(56) References Cited

U.S. PATENT DOCUMENTS

| | | | | |
|---|---|---|---|---|
| 5,944,958 | A * | 8/1999 | Svanqvist | 162/281 |
| 5,958,513 | A * | 9/1999 | Madrzak | 427/356 |
| 6,356,201 | B1 | 3/2002 | Alles | |
| 6,830,659 | B2 * | 12/2004 | Sovijarvi | 162/263 |
| 7,108,766 | B1 * | 9/2006 | Eskelinen et al. | 162/263 |
| 7,264,692 | B2 * | 9/2007 | Isometsa et al. | 162/198 |
| 7,311,804 | B2 * | 12/2007 | Breiten et al. | 162/280 |
| 8,337,668 | B2 * | 12/2012 | Berendes et al. | 162/281 |
| 2013/0103326 | A1 * | 4/2013 | Von Drasek et al. | 702/56 |
| 2015/0159327 | A1 * | 6/2015 | Echeverria Garcia | D21G 3/005 162/252 |

FOREIGN PATENT DOCUMENTS

| | | | | |
|---|---|---|---|---|
| EP | 1244850 | B1 | 10/2002 | |
| EP | 1310592 | A2 | 5/2003 | |
| ES | EP 2883999 | A1 * | 6/2015 | D21G 3/005 |
| WO | WO01/20077 | A1 | 3/2001 | |
| WO | WO 0120077 | A1 * | 3/2001 | |
| WO | WO02/072452 | A2 | 9/2002 | |
| WO | WO2012117160 | A1 | 9/2012 | |

* cited by examiner

DOCTOR FOR A PAPER MACHINE

CROSS-REFERENCE TO RELATED APPLICATION

This application relates to and claims the benefit and priority to European Patent Application No. EP13382502, filed Dec. 11, 2013.

TECHNICAL FIELD

The present invention is related to a doctor for a paper machine.

BACKGROUND

Some tools or elements in some machines are exposed to wear and must be periodically replaced. This is the case of paper machines used for manufacturing paper where a doctor with at least one blade that wears with use and must be periodically replaced is used.

Such machines have at least one roller from which the paper is generated, and the doctor can have different uses such as for cleaning the surface of the rollers or peeling the sheet of paper from the surface on which it adheres, for example. As mentioned, the doctor comprises at least one blade which acts on the roller by contact and which suffers wear, and further comprises a blade holder which supports the blade and allows assembling and removing same.

A way for detecting the wear of the blade before it becomes pernicious is by means of actual user experience, or even visually. These are not the most advisable techniques because the detection of the wear before it becomes pernicious is not assured in all cases (due to user oversight, for example) and also because it is not a comfortable and fast way for detecting same.

Other methods are also known where the wear of the blade is manually measured by means of devices that are suitable for such purpose in order to detect whether or not it is acceptable. For this purpose, the machine must be stopped periodically (periods which can depend on user experience or on previously established time, for example), accessing the blade with the relevant device and taking the measurement (there are cases in which it may even be necessary to completely or partially remove the blade from the doctor to take the measurement).

Document EP 1310592 A2 discloses measurement means for measuring the wear of the blade. The measurement can be taken contacting or without contacting the blade and in both cases a relative movement is required between the measurement means and the blade which allows measuring the wear of a blade when the blade is being changed, for example.

Document EP 1244850 A1 discloses a doctor in which the wear of the blade can be detected or measured during the operation thereof. The doctor comprises a blade, a support or blade holder which holds the blade and a main support which in turn holds the support, the support being able to rotate with respect to the main support. In one embodiment, the doctor comprises a sensor in the blade holder or in the main support for detecting the rotation or the movement between them, the wear of the blade being estimated depending on this detection. In another embodiment, the doctor comprises a plurality of optical fibers arranged in parallel in the blade, whereby light is passed there through such that, if a fiber is broken due to the wear of the blade, light no longer goes through the fiber and this event is detected, the wear thus being detected.

SUMMARY OF THE DISCLOSURE

A doctor for use in a paper machine and comprises at least one blade for scraping the surface of a paper roller and detection means which is associated with the blade and which, like the blade, is exposed to wear due to the contact with the roller. The detection means comprises a wearing element which is arranged in the blade and which is exposed to wear and a reading element associated with the wearing element.

The reading element excites the wearing element with a magnetic signal and the wearing element responds with a magnetic response signal which is received by the reading element, the magnetic response signal comprising a specific frequency varying with the wear of the wearing element, such that the frequency of the magnetic response signal is representative of the wear of the wearing element and therefore of the blade. Therefore, by means of detecting the frequency the wear of the blade (even the level of wear of the blade) or the absence of a useful blade when the wear reaches a predetermined level can be detected easily and without having to stop the paper manufacturing machine, for example.

These and other advantages and features will become evident in view of the drawings and the detailed description of the invention.

DETAILED DESCRIPTION

Figure 1:
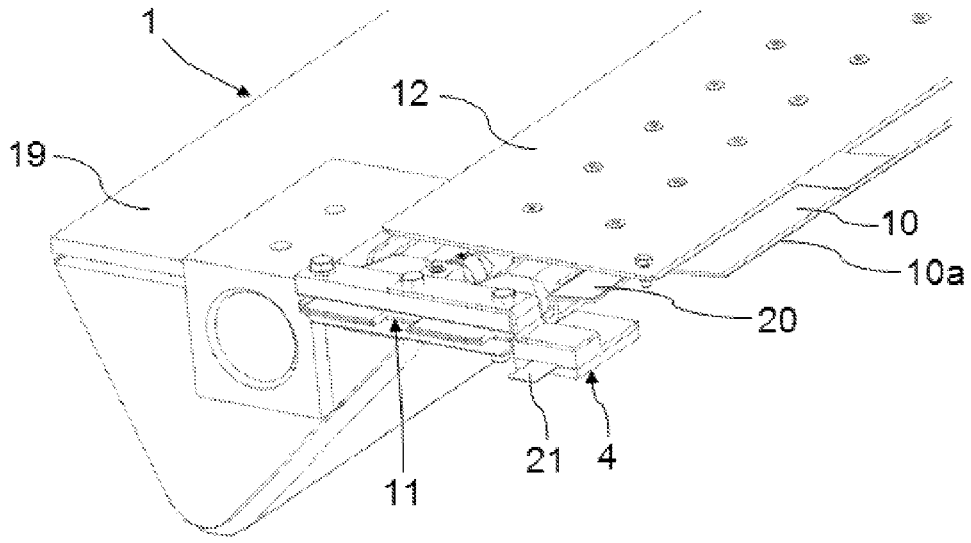
FIG. 1 is a partial perspective view of a doctor according to one implementation.
Figure 2:
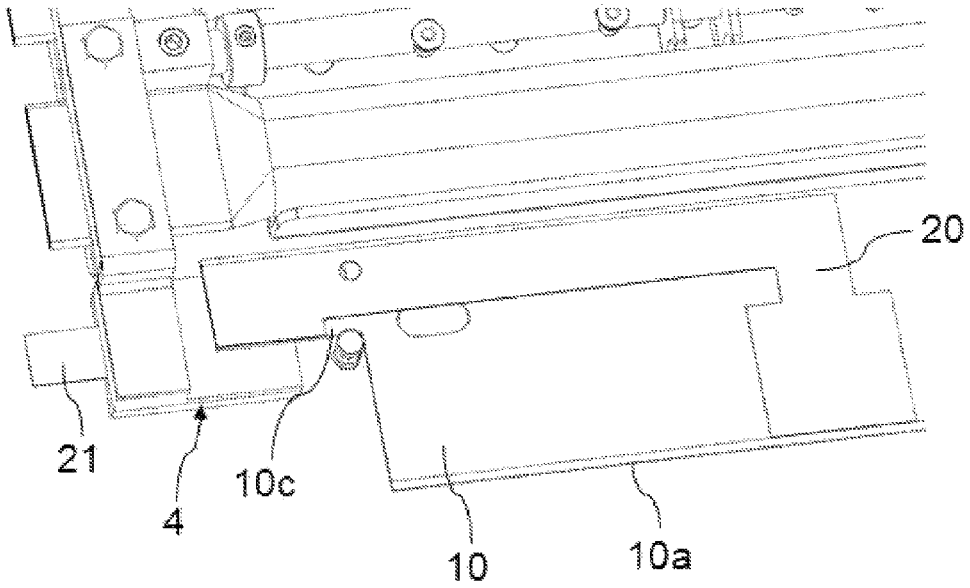
FIG. 2 is a partial plan view of the doctor of FIG. 1 without a support plate.
Figure 3:
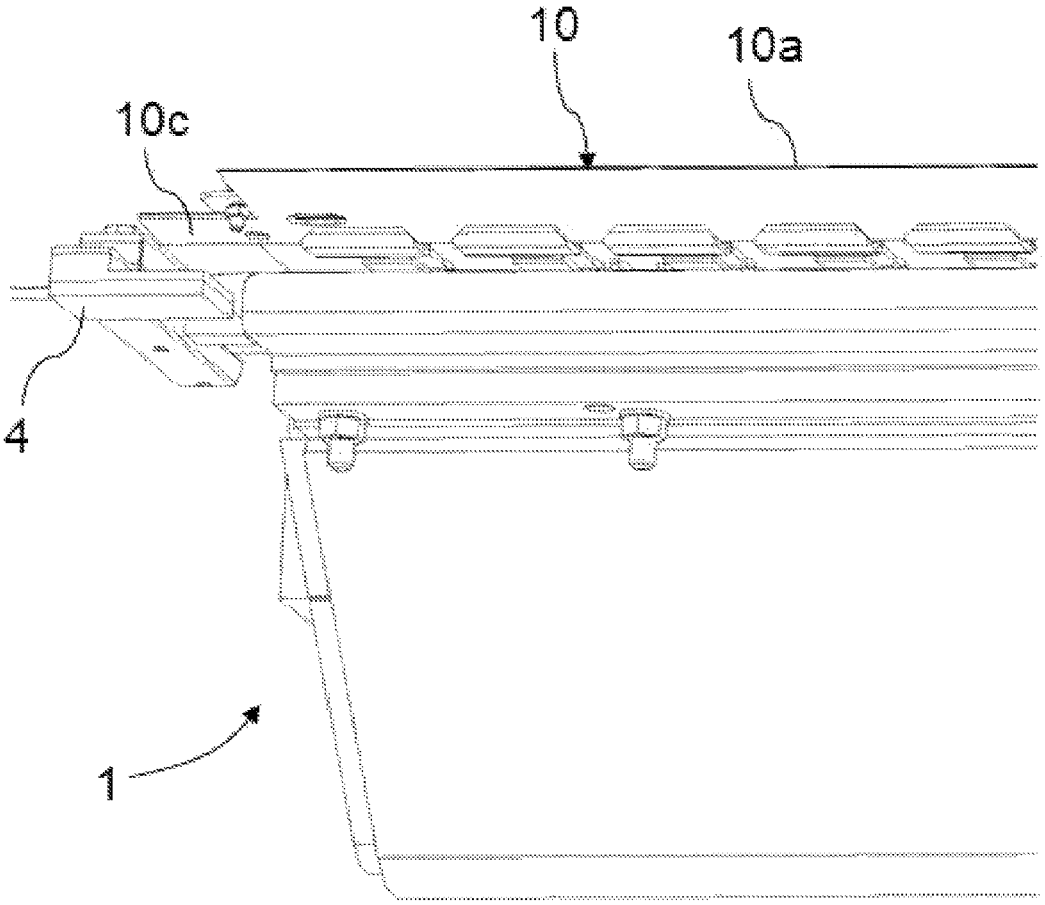
FIG. 3 is a partial bottom view of the doctor of FIG. 1.

FIGS. 1 to 3 schematically show a doctor 1 according to some implementations that is suitable for being used in a paper machine. The doctor 1 is attached to a structure (not depicted in the drawings) of the machine and comprises a blade holder 11, a blade 10 which is supported by the blade holder 11, which acts on a roller (not depicted in the drawings) of the machine for scraping same and which wears with use due to the action, and can comprise a support plate 12 which is arranged connected to the blade 10 and which helps the blade 10 to act on the roller. It is also be possible that the doctor 1 not comprise a support plate. The blade holder 11 holds the blade 10 at one end of the blade 10, whereas the other end 10*a* of the blade 10 (the leading end of the blade that acts on the roller of the paper machine) is designed for acting on the roller. It is also possible that the doctor 1 does not comprise a blade holder 11 for holding the blade 10, the blade 10 being directly attached to structure 19 of the doctor 1 by means of conventional attachment means, for example.

The doctor 1 further comprises detection means which is associated with the blade 10 and which, like the blade 10, is exposed to wear due to contact with the roller. The detection means comprises a wearing element 20 arranged in or on the blade 10, and a reading element 21 associated with the wearing element 20. The wearing element 20 is arranged in or on the blade 10 such that it contacts the roller and is exposed to wear, being worn to substantially the same extent as the blade 10 wears. The reading element 21 is suitable for transmitting a magnetic excitation signal to the wearing element 20 and for capturing a magnetic signal from the wearing element 20 as a response to the magnetic excitation signal. As the wearing element 20 wears, the magnetic response signal to be received by the reading element 21 varies such that by means of detecting/determining the variation the wear of the wearing element 20, and therefore of the blade 10, can be determined as will be discussed in more detail below.

According to some implementations the magnetic response signal comprises a specific frequency varying with the wear of the wearing element 20, such that the frequency of the signal is representative of the wear (or of the level of wear) of the wearing element 20, and therefore of the wear of the blade 10. The arrangement of the wearing element 20 in the blade 10 with respect to the end 10*a* of the blade 10 depends on the degree of wear to be measured, for example:

The wearing element 20 can be arranged such that it is flush with the end 10*a* of the blade 10, such that the wearing element 20 contacts the roller and starts to wear from the time in which the blade 10 wears. The change in the frequency of the magnetic response signal is therefore directly proportional to the wear of the blade 10.

The wearing element 20 can be arranged at a specific distance with respect to the end 10*a* of the blade 10, such that the wearing element 20 starts to wear once the blade 10 has worn up to a previously established point (the positioning of the wearing element 20 depends on the selection of the point). The change in the frequency of the magnetic response signal is therefore proportional to the wear of the blade 10, although in order to determine the total wear of the blade 10, the wear thereof until the wearing element 20 starts to wear (until the frequency of the magnetic response signal starts to change), which is known in advance (previously established point), must be taken into account.

Figure 4:
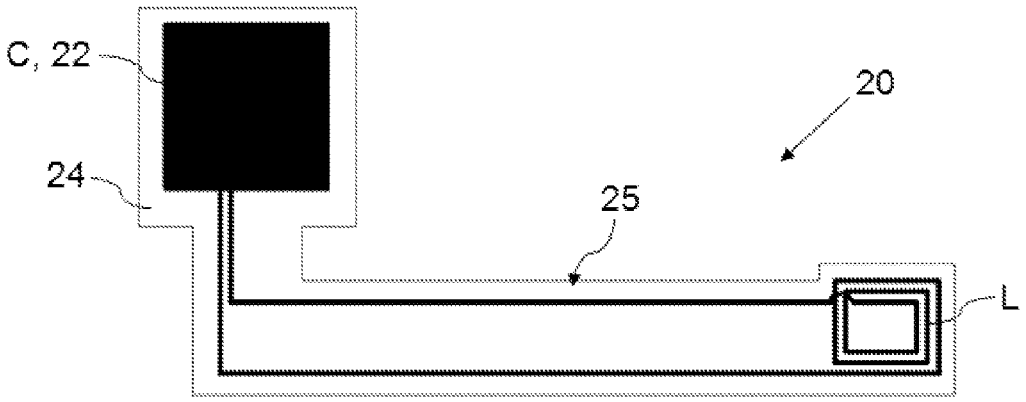
FIG. 4 is a schematic plan view of a wearing element according to one implementation.
Figure 5:
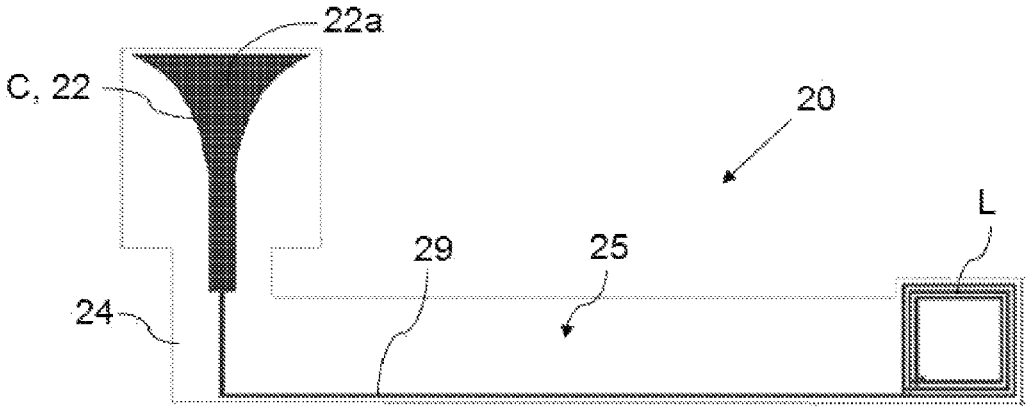
FIG. 5 is a schematic plan view of a wearing element according to another implementation.
Figure 6:
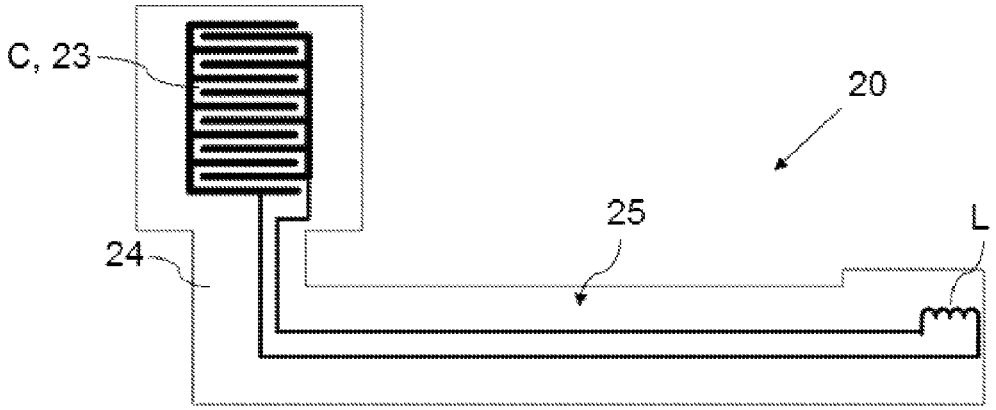
FIG. 6 is a schematic plan view of a wearing element according to another implementation.

According to some implementations the wearing element 20 comprises an inductive element L and a capacitive element C forming a resonant circuit with a specific resonance frequency, as schematically shown by way of example in FIGS. 4 to 6, the resonance frequency being the frequency of the magnetic response signal. The resonance frequency is determined from the following equation:

$$Fr = \frac{1}{2\pi\sqrt{LC}}$$

wherein:

Fr: Resonance frequency.

L: Inductance of the inductive element.

C: Capacitance of the capacitive element.

Therefore, the resonance frequency depends on the values of the inductive element L and of the capacitive element C, a specific resonance frequency is thus established when designing the resonant circuit. When the wearing element 20 wears, at least one of the elements L or C wears physically, changing the value thereof, such that the resonance frequency also changes as a result of the wear.

Figure 7:
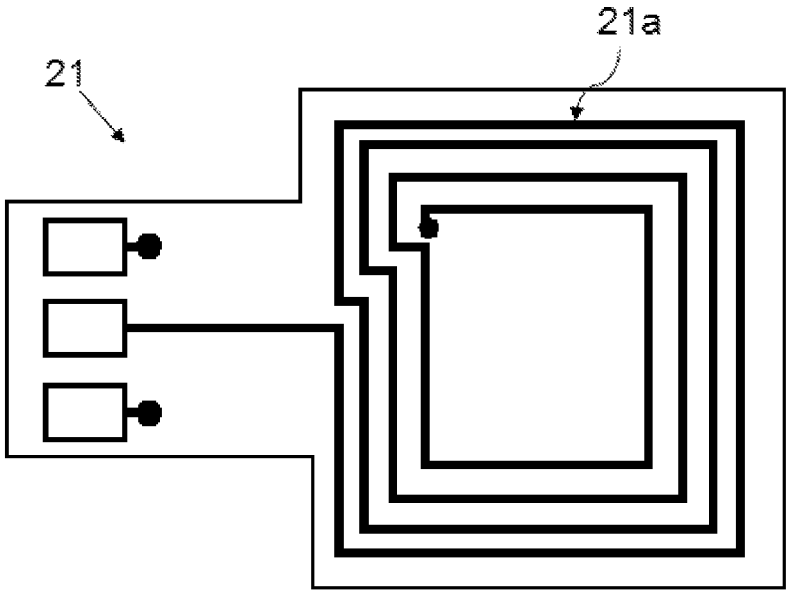
FIG. 7 is a plan view of a reading element according to one implementation.

According to some implementations the purpose of the inductive element L is at least to achieve, together with the capacitive element C, the resonance of the resonant circuit at a certain resonance frequency, to capture the magnetic signal coming from the reading element 21 and to transmit a magnetic response signal to the reading element 21 as a response of the excitation received from the reading element 21, the magnetic response signal comprising a specific resonance frequency which depends on the inductance value of the inductive element L and on the capacitance value of the capacitive element C. According to some implementations the inductive element L corresponds with a coil and the reading element 21 comprises another coil 21*a* as that shown by way of example in FIG. 7, such that a magnetic coupling is generated between both coils resulting in the excitation of the wearing element and the magnetic response signal of the inductive element L (of the wearing element 20). The coil of the inductive element L can be made in different manners, as schematically shown in the examples of FIGS. 4 to 6.

By knowing the initial resonance frequency, knowing when the detection means starts to wear can be easily determined by monitoring when the resonance frequency of the resonant circuit of the detection means begins to change. To that end, the machine can comprise control means (not depicted in the drawings) suitable for interpreting the information received by the reading element 21 of the detection means. The control means is communicated with the reading element 21, and can correspond with specific control means for performing this function (which may be located in the doctor 1) or with control means of the machine that are programmed or designed for furthermore performing this function (for example, the microprocessor, controller or equivalent central device of the machine which controls machine operations).

The coils both of the reading element 21 and of the wearing element 20 can be a printed circuit or the like, can correspond with commercial coils, with ferrite cores or with any other conventional element.

According to some implementations the reading element 21 further comprises an electronic unit (not depicted in the drawings) capable of generating a signal with a specific frequency (or with a frequency within a specific range) which is fed to the coil 21*a* which is magnetically coupled with the inductive element L of the wearing element 20. The electronic unit can correspond with a generator that generates a sinusoidal signal (or another type of frequency wave) or with an oscillator circuit, for example. The power supply for powering the electronic unit to generate the magnetic excitation signal can come from the general power supply of the machine, for example, and the electronic unit can be continuously powered throughout the operation of the machine.

According to some implementations the wearing element 20 comprises a substantially L-shape with a first section extending parallel to an end 10*a* of the blade 10 and a second section transverse to the first section, the capacitive element C being arranged in the second section and the inductive element L being arranged in the first section. According to some implementations the inductive element L is arranged at the end of the first section furthest from the second section. The wearing element 20 comprises a base 24 in which (or on which) the capacitive element C, the inductive element L and an attachment area 25 between both elements C and L are arranged, the area conferring the wearing element 20 with the substantially L-shape. The attachment area 25 corresponds with the physical attachment between the capacitive element C and the inductive element L.

According to some implementations the capacitive element C of the wearing element 20 is exposed to wear, such that the resonance frequency of the resonant circuit changes (increases) due to the physical wear of the capacitive element C (reduced capacitance value). Therefore, the second section of the wearing element 20 is closer to the end 10*a* of the blade 10 than the first section. In addition to achieving, together with the inductive element L, the resonance of the resonant circuit at a certain resonance frequency, the purpose of the capacitive element C is to therefore act as a sensor element itself. The capacitive element C is subjected to the wear of the blade 10 of the doctor 1, which would cause a reduction in the capacitance thereof and therefore an increase in the resonance frequency of the resonant circuit which it forms together with the inductive element L.

According to some implementations the blade 10 comprises a flange 10*c* at one end on which there is arranged the end of the first section of the base 20 of the wearing element 20 where the inductive element L is arranged. The flange 10*c* preferably prolongs parallel to the end 10*a* as shown in FIGS. 2 and 3. The doctor 1 comprises a support 4 which is attached to the blade holder 11 (or which forms part of the blade holder 11, corresponding with an extension of the blade holder 11) and which is facing the flange 10*c* of the blade 10, where the reading element 21 of the detection means is arranged, such that the reading element 21 is facing the flange 10*c* and therefore the inductive element L of the wearing element 20, which allows the magnetic coupling between the wearing element 20 and the reading element 21. It is also possible to achieve the coupling in other ways, such as facing the wearing element 20 and the reading element 21 to one another in the horizontal plane instead of in the vertical plane, or even without facing them to one another (having them within one and the same area of influence is sufficient, depending on the magnetic signal emission/reception strength).

According to some implementations the capacitive element C of the resonant circuit corresponds with a planar capacitor 22 such as that shown by way of example in FIG. 4, formed by two metal plates arranged in parallel (only one plate is shown in FIG. 4), which can be copper plates (due to their high conductivity), for example, separated by insulation means such as air or glass fiber, for example. Each metal plate is attached to one end of the induction element L by means of a copper conductive wire 29, for example. When the capacitive element C wears, the area of the two metal plates forming the planar capacitor 22 decreases, the capacitance of the capacitive element C being reduced and the resonance frequency of the resonant circuit which it forms together with the inductive element L being increased.

According to some implementations the wearing element 20 corresponds with a label adhered on the blade 10 (although it could also be arranged on the blade by attaching it to the blade 10 by means of another type of attachments or fastenings), such that the assembly thereof is very simple and quick.

According to some implementations the capacitive element C of the wearing element 20 comprises a planar capacitor 22 with a non-rectangular shape. For example, the planar capacitor 22 may comprise a maximum width at its end 22*a* closest to the end 10*a* of the blade 10, which corresponds with the end thereof that is exposed most to wear, the width being reduced as it becomes further away from the end 22*a*, as shown in FIG. 5. The width is reduced to facilitate or simplify the determination of the wear of the wearing element 20 and therefore of the blade 10, and has the purpose of providing a linear or substantially linear change in the resonance frequency as the wear of the wearing element 20 increases. With a linear change the level of wear of the blade 10 can be determined or calculated in a simpler manner. Therefore, the width is not reduced in a linear manner, but rather a non-linear (or non-uniform) manner whereby the linear change in the resonant frequency is achieved, such as the shape of the planar capacitor 22 depicted in FIG. 5. FIG. 5 shows a single plate of the capacitor and a single conductive wire 29, but each plate will be communicated with a corresponding end of the inductive element L with the corresponding conductive wire thereof.

According to some implementations the capacitive element C of the wearing element 20 does not correspond with a planar capacitor. In this case, the capacitive element C corresponds with an interdigitated capacitance 23 formed by conductive strips, such as that shown by way of example in FIG. 6. When the wearing element 20 wears, the wear occurs on the conductive strips that will be gradually removed as the wear progresses, the capacitance value of the capacitive element C formed by the interdigitated capacitance 23 being reduced and the resonance frequency of the resonant circuit of the wearing element 20 thus being increased. The conductive strips are manufactured with a metal material such as copper.

What is claimed is:

1. A doctor for a paper machine comprising:

a blade, a wearing element located in or on the blade so that at least a portion of the wearing element is exposed to wear as the blade is worn; and a reading element positioned in proximity to the wearing element, wherein the reading element is configured to emit a magnetic signal to excite the wearing element and the wearing element is configured to respond to the magnetic signal with a magnetic response signal, the reading element configured to receive the magnetic response signal, the magnetic response signal comprising a frequency that varies with the wear of the wearing element such that the frequency of the magnetic response signal is representative of the wear of the wearing element.

2. A doctor according to claim 1, wherein the wearing element comprises a resonant circuit such that the frequency of the magnetic response signal corresponds with the resonance frequency of the resonant circuit, the resonant circuit being formed by an inductive element electrically coupled with a capacitive element, the resonance frequency of the resonant circuit depending on the inductance value of the inductive element and on the capacitance value of the capacitive element.

3. A doctor according to claim 2, wherein the wearing element is arranged in or on the blade in such a manner that the capacitive element is exposed to wear as the blade wears, the resonance frequency of the resonant circuit being changed when the capacitive element wears.

4. A doctor according to claim 3, wherein the capacitive element of the resonant circuit comprises a planar capacitor formed by two spaced-apart metal plates arranged in parallel, the two metal plates being electrically coupled with respective ends of the inductive element by means of conductive elements.

5. A doctor according to claim 4, wherein the planar capacitor comprises a shape that has a maximum width at an area located at or adjacent a leading end of the blade, the width of the shape diminishing as it extends away from the leading end of the blade.

6. A doctor according to claim 5, wherein the width of the shape diminishes in a non-linear manner as it extends away from the leading end of the blade.

7. A doctor according to claim 4, wherein the planar capacitor comprises a shape so that as the planar capacitor wears the change in the resonance frequency of the resonant circuit increases.

8. A doctor according to claim 4, wherein the planar capacitor comprises a shape so that as the planar capacitor wears the change in the resonance frequency of the resonant circuit increases in a substantially linear manner.

9. A doctor according to claim 3, wherein the capacitive element of the resonant circuit corresponds with an interdigitated capacitance formed by a plurality of conductive strips that are electrically coupled with the inductive element.

10. A doctor according to claim 9, wherein at least some of the conductive strips located nearest a leading end of the blade are arranged substantially parallel to the leading end of the blade.

11. A doctor according to claim 2, wherein the wearing element comprises a substantially L-shape with a first section and a second section transverse to the first section, the capacitive element being arranged in the second section and the inductive element being arranged in the first section.

12. A doctor according to claim 11, wherein the inductive element is arranged at an end of the first section furthest from the second section.

13. A doctor according to claim 1, wherein the reading element faces the inductive element of the wearing element.

14. A doctor according to claim 13, further comprising a support facing the inductive element, the reading element being arranged on the support.

15. A doctor according to claim 14, further comprising a blade holder that holds the blade, the support being attached to the blade holder.

16. A doctor according to claim 14, further comprising a blade holder that holds the blade, the support being an extension of the blade holder.

17. A doctor according to claim 1, wherein the wearing element is arranged on or in the blade so that the wearing element wears simultaneously and substantially to the same extent as the blade.

18. A doctor according to claim 1, wherein the wearing element is arranged in or on the blade a distance from the leading end of the blade.

19. A doctor according to claim 1, wherein the wearing element comprises a label that is attached to a surface of the blade.

* * * * *